US011821141B2

(12) United States Patent
Chen et al.

(10) Patent No.: US 11,821,141 B2
(45) Date of Patent: Nov. 21, 2023

(54) AIRLAID SUBSTRATES HAVING AT LEAST ONE BICOMPONENT FIBER

(71) Applicant: Dow Global Technologies LLC, Midland, MI (US)

(72) Inventors: Lihua Chen, Shanghai (CN); Phil Xu, Shanghai (CN); Shenglong Chen, Shanghai (CN)

(73) Assignee: Dow Global Technologies LLC, Midland, MI (US)

( * ) Notice: Subject to any disclaimer, the term of this patent is extended or adjusted under 35 U.S.C. 154(b) by 177 days.

(21) Appl. No.: 17/311,485

(22) PCT Filed: Dec. 10, 2018

(86) PCT No.: PCT/CN2018/119989
§ 371 (c)(1),
(2) Date: Jun. 7, 2021

(87) PCT Pub. No.: WO2020/118479
PCT Pub. Date: Jun. 18, 2020

(65) Prior Publication Data

US 2022/0025580 A1 Jan. 27, 2022

(51) Int. Cl.

| | |
|---|---|
| ***D21H 15/10*** | (2006.01) |
| ***D04H 1/26*** | (2012.01) |
| ***D04H 1/732*** | (2012.01) |
| ***D21H 13/14*** | (2006.01) |
| ***D21H 13/18*** | (2006.01) |
| ***D21H 27/00*** | (2006.01) |

(52) U.S. Cl.
CPC ..... *D21H 15/10* (2013.01); *D04H 1/26* (2013.01); *D04H 1/732* (2013.01); *D21H 13/14* (2013.01); *D21H 13/18* (2013.01); *D21H 27/002* (2013.01); *D10B 2321/022* (2013.01); *D10B 2321/08* (2013.01)

(58) Field of Classification Search
CPC .... D04H 1/06; D01F 8/06; D01F 6/46; D01D 5/06
USPC ..... 162/146
See application file for complete search history.

(56) References Cited

U.S. PATENT DOCUMENTS

| | | | |
|---|---|---|---|
| 3,264,272 | A | 8/1966 | Rees |
| 3,645,992 | A | 2/1972 | Elston |
| 3,914,342 | A | 10/1975 | Mitchell |
| 4,076,698 | A | 2/1978 | Anderson et al. |
| 4,766,174 | A | 8/1988 | Statz |
| 4,950,541 | A | 8/1990 | Tabor et al. |
| 5,272,236 | A | 12/1993 | Lai et al. |
| 5,278,272 | A | 1/1994 | Lai et al. |
| 5,582,923 | A | 12/1996 | Kale et al. |
| 5,733,155 | A | 3/1998 | Sagawa |
| 5,854,045 | A | 12/1998 | Fang et al. |
| 5,981,410 | A | 11/1999 | Hansen et al. |
| 2003/0064651 | A1 | 4/2003 | Nakai et al. |
| 2005/0148268 | A1 | 7/2005 | Tai |
| 2006/0025527 | A1 | 2/2006 | Chou |
| 2011/0165470 | A1 | 7/2011 | Dahringer et al. |
| 2014/0323003 | A1 | 10/2014 | Richeson et al. |

FOREIGN PATENT DOCUMENTS

| | | | |
|---|---|---|---|
| CN | 1259178 | A | 7/2000 |
| DE | 29913054 | U | 11/1999 |
| EP | 0465203 | B1 | 7/1991 |
| EP | 0973966 | B1 | 9/2002 |
| EP | 1350869 | A1 | 10/2003 |
| JP | H03161512 | A | 7/1991 |
| JP | H04-241193 | A | 8/1992 |
| JP | 2003-049360 | A | 2/2003 |
| JP | 2005194683 | A | 7/2005 |
| JP | 2013-076192 | A | 4/2013 |
| JP | 2014-502315 | A | 1/2014 |
| WO | 98/45519 | A1 | 10/1998 |
| WO | 03099930 | A1 | 12/2003 |
| WO | 2005007716 | A1 | 1/2005 |

OTHER PUBLICATIONS

International Search Report and Written Opinion pertaining to PCT/CN2018/119989, dated Aug. 28, 2019.
Chinese Office Action and Search Report issued by the Chinese Patent Office for Chinese Patent Application No. 201880100577.6 dated Aug. 3, 2022 (10 total pages).
Japanese Office Action issued by the Japanese Patent Office for related Japanese Patent Application No. 2021-532861 dated Dec. 13, 2022 (3 total pages).
JP Office Action, dated Jul. 25, 2023, pertaining to Japanese Patent Application No. 2021-532861, 10 pgs.
CN Office Action, dated Sep. 1, 2023, pertaining to Chinese Patent Application No. 201880100577.6, 9 pgs.

*Primary Examiner* — Mark Halpern
(74) *Attorney, Agent, or Firm* — Dinsmore & Shohl LLP

(57) ABSTRACT

An airlaid substrate includes at least one bicomponent fiber having a first region and a second region. The first region includes polypropylene and the second includes a blend of an ethylene-base polymer and an ethylene acid copolymer. The ethylene-base polymer has a density from 0.920 g/cm$^3$ to 0.970 g/cm$^3$ and a melt index ($I_2$) from 0.5 g/10 min to 150 g/10 min. The ethylene acid copolymer includes the polymerized reaction product of from 60 wt % to 99 wt % ethylene monomer and from 1 wt % to 40 wt % unsaturated dicarboxylic acid comonomer, based on the total weight of the monomers in the ethylene acid copolymer. The ethylene acid copolymer having a melt index ($I_2$) from 0.5 g/10 min to 500 g/10 min.

17 Claims, 2 Drawing Sheets

AIRLAID SUBSTRATES HAVING AT LEAST ONE BICOMPONENT FIBER

This application is a 371 of PCT/CN2018/119989 filed 10 Dec. 2018

TECHNICAL FIELD

Embodiments of the present disclosure generally relate to airlaid substrates, and are specifically related to airlaid substrates including at least one bicomponent fiber having a first region and a second region.

BACKGROUND

Airlaid substrates, such as airlaid nonwoven fabrics, are commonly used materials in various applications because they are soft, non-limiting, strong, and absorbent. These materials are primarily used in personal care products such as, for example, baby diapers, adult incontinence products, and feminine hygiene products.

Common airlaid substrates include blends of paper fibers and a bicomponent layer formed from polyethylene and polypropylene. These typical airlaid substrates, though, suffer from poor adhesion between the paper fibers and the bicomponent layer. Poor adhesion is associated with high dust levels, which are undesirable in airlaid substrates. As such, additives like maleic anhydride grafted materials have been added to the bicomponent layer with the goal of promoting adhesion and thereby decreasing the dust level. However, exorbitant amounts of energy are needed to accelerate the bonding between the paper fibers and the bicomponent layer that includes maleic anhydride grafted materials.

SUMMARY

Accordingly, it may be beneficial to develop alternative airlaid substrates having improved adhesion. The present airlaid substrates meet these needs and show improved adhesion as indicated by lower dust levels and higher tensile strength when compared to conventional airlaid substrates.

In embodiments, airlaid substrates of this disclosure include at least one bicomponent fiber having a first region and a second region, wherein the first region includes polypropylene and the second region includes a blend. The blend includes an ethylene-based polymer and an ethylene acid copolymer. The ethylene-based polymer has a density of 0.920 g/cm$^3$ to 0.970 g/cm$^3$ and a melt index ($I_2$) of 0.5 g/10 min. to 150 g/10 min., as determined by ASTM D1238 at 190° C. and 2.16 kg. The ethylene acid copolymer includes the polymerized reaction product of from 60 wt. % to 99 wt. % ethylene monomer and from 1 wt. % to 40 wt. % unsaturated dicarboxylic acid comonomer, based on the total weight of the monomers in the ethylene acid copolymer. Moreover, the ethylene acid copolymer has a melt index ($I_2$) of 0.5 g/10 min. to 500 g/10 min., as determined by ASTM D1238 at 190° C. and 2.16 kg.

DETAILED DESCRIPTION

Figure 1:
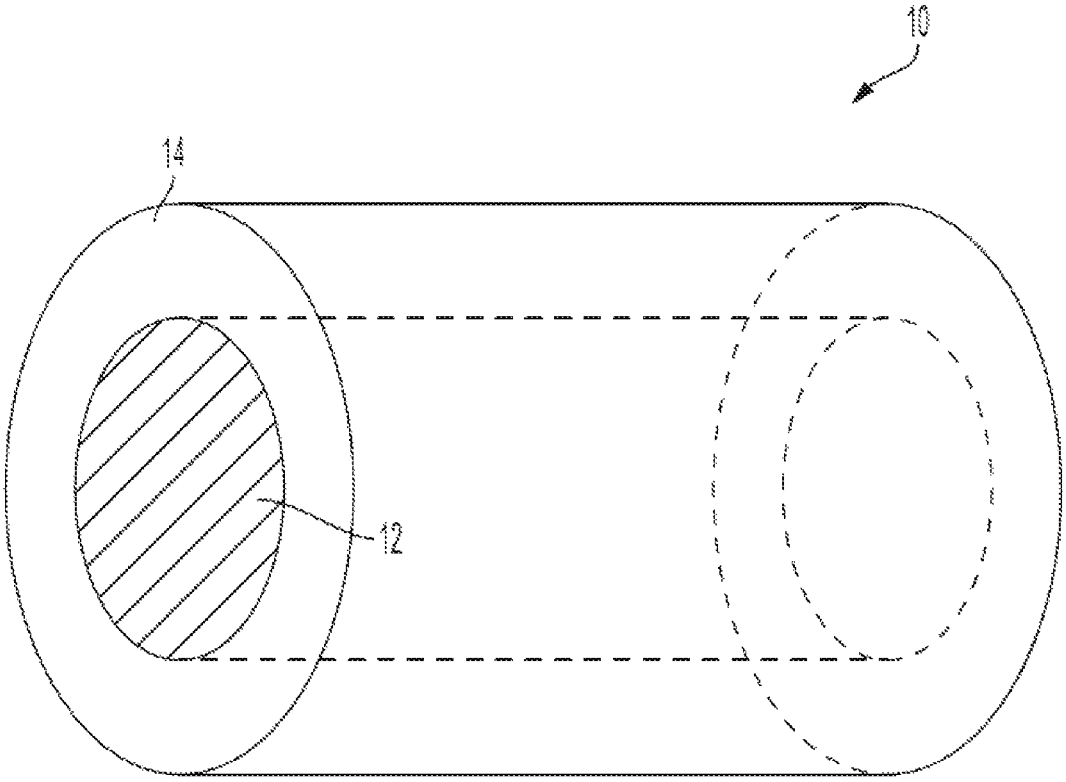
FIG. 1 is a perspective view of the bicomponent fiber, according to one or more embodiments.

Unless otherwise defined, all technical and scientific terms used herein have the same meaning as commonly understood by one of ordinary skill in the art to which this disclosure belongs. In case of conflict, the specification, including definitions, will control.

Although methods and materials similar or equivalent to those described herein can be used in the practice or testing of various embodiments, suitable methods and materials are described herein.

Unless stated otherwise, all percentages, parts, ratios, and the like, are by weight. When an amount, concentration, or other value or parameter is given as either a range, preferred range, or a list of lower preferable values and upper preferable values, this is to be understood as specifically disclosing all ranges formed from any pair of any lower range limit or preferred value and any upper range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

When the term "about" is used in describing a value or an end-point of a range, the disclosure should be understood to include the specific value or end-point referred to.

As used herein, the terms "comprises," "comprising," "includes," "including," "containing," "characterized by," "has," "having," or any other variation thereof, are intended to cover a non-exclusive inclusion. For example, a process, method, article, or apparatus that comprises a list of elements is not necessarily limited to those elements but may include other elements not expressly listed or inherent to such process, method, article, or apparatus. Further, unless expressly stated to the contrary, "or" refers to an inclusive or and not to an exclusive or.

The transitional phrase "consisting essentially of" limits the scope of a claim to the specified materials or steps and those that do not materially affect the basic and novel characteristic(s) of the disclosure. Where applicants have defined an embodiment or a portion thereof with an open-ended term such as "comprising," unless otherwise stated, the description should be interpreted to also describe such an embodiment using the term "consisting essentially of."

Use of "a" or "an" are employed to describe elements and components of various embodiments. This is merely for convenience and to give a general sense of the various embodiments. This description should be read to include one or at least one and the singular also includes the plural unless it is obvious that it is meant otherwise.

The term "polymer" refers to a polymeric compound prepared by polymerizing monomers, whether of the same or a different type. The generic term polymer thus embraces the terms "homopolymer" and "copolymer." The term "homopolymer" refers to polymers prepared from only one type of monomer; the term "copolymer" refers to polymers prepared from two or more different monomers, and for the purpose of this disclosure may include "terpolymers" and "interpolymers."

The term "bicomponent fiber" as used in this disclosure means a fiber comprised of two polymers of different chemical and/or physical properties extruded from the same spinneret with both polymers being within the same filament. The two polymers may be arranged in a sheath region/core region arrangement, such that a first region comprises the sheath region of the fiber and a second region comprises the core region of the fiber.

The term "unsaturated dicarboxylic acid comonomer" as used in this disclosure means a molecule having a reactive portion, such as a vinyl or vinylene, that may bond to other monomers to form a polymer and two carboxylic acid (—C(O)OH) groups that are not included in the reactive portion. Additionally, "unsaturated dicarboxylic acid monomer" includes unsaturated dicarboxylic acid derivative monomers, such as half esters and anhydrides.

The term "ethylene acid copolymer" as used in this disclosure means the polymerization product of at least one ethylene monomer and at least one acid comonomer. One such suitable ethylene acid copolymer may include the polymerized reaction product of an ethylene monomer and the unsaturated dicarboxylic acid comonomer, as described previously in this disclosure The term "pulp" as used in this disclosure means any fibrous material prepared by chemically or mechanically by separating fibrous material from wood, fiber crops, waste paper, or rags. The most common fibrous material is cellulosic material.

The term "wood pulp" as used in this disclosure means any pulp originating from timber sources. This term encompasses mechanical pulp (i.e., lignin-free wood pulp), thermomechanical pulp, chemical pulp, and recycled pulp.

The term "fluff pulp" as used in this disclosure means any chemical pulp made from softwood fibers. Specifically, the term "fluff pulp" may mean a nonwoven component which is prepared by mechanically grinding rolls of pulp, and then aerodynamically transporting the pulp to web forming components of air laying or dry forming machines.

The term "softwood fibers" as used in this disclosure means fibrous pulps derived from the woody substance of coniferous trees such as varieties of fir, spruce, pine, or the like. Suitable trees may include, but are not limited to loblolly pine, slash pine, Colorado spruce, balsam fir, Douglas fir, jack pine, *radiata* pine, white spruce, lodgepole pine, redwood, or the like. North American southern softwoods and northern softwoods may be used to provide softwood fibers, as well as softwoods from other regions of the world.

The term "polymer" refers to a polymeric compound prepared by polymerizing monomers, whether of the same or a different type. The generic term polymer thus embraces the term "homopolymer," usually employed to refer to polymers prepared from only one type of monomer as well as "copolymer," which refers to polymers prepared from two or more different monomers. The term "interpolymer," as used herein, refers to a polymer prepared by the polymerization of at least two different types of monomers. The generic term "interpolymer" thus includes copolymers, and polymers prepared from more than two different types of monomers, such as terpolymers or quaterpolymers.

The term "ethylene-based polymer" or "polyethylene" as used in this disclosure means polymers comprising greater than 50% by mole of units which have been derived from ethylene monomer. This includes polyethylene homopolymers or copolymers (meaning units derived from two or more comonomers). Common forms of polyethylene known in the art include Low Density Polyethylene (LDPE); Linear Low Density Polyethylene (LLDPE); single-site catalyzed Linear Low Density Polyethylene, including both linear and substantially linear low density resins (m-LLDPE); Medium Density Polyethylene (MDPE); and High Density Polyethylene (HDPE).

The term "LDPE" may also be referred to as "high pressure ethylene polymer" or "highly branched polyethylene" and is defined to mean that the polymer is partly or entirely homopolymerized or copolymerized in autoclave or tubular reactors at pressures above 14,500 psi (100 MPa) with the use of free-radical initiators, such as peroxides (see, for example, U.S. Pat. No. 4,599,392, incorporated herein by reference). LDPE resins typically have a density in the range of 0.916 to 0.940 g/cc.

The term "LLDPE", includes both resin made using the traditional Ziegler-Natta catalyst systems as well as single-site catalysts such as metallocenes (sometimes referred to as "m-LLDPE"). LLDPEs contain less long chain branching than LDPEs and include the substantially linear ethylene polymers which are further defined in U.S. Pat. Nos. 5,272,236, 5,278,272, 5,582,923 and 5,733,155; the homogeneously branched linear ethylene polymer compositions such as those in U.S. Pat. No. 3,645,992; the heterogeneously branched ethylene polymers such as those prepared according to the process disclosed in U.S. Pat. No. 4,076,698; and/or blends thereof (such as those disclosed in U.S. Pat. No. 3,914,342 or 5,854,045). The linear PE can be made via gas-phase, solution-phase or slurry polymerization or any combination thereof, using any type of reactor or reactor configuration known in the art, including but not limited to gas and solution phase reactors.

The term "HDPE" refers to polyethylenes having densities greater than about 0.940 g/cc, which are generally prepared with Ziegler-Natta catalysts, chrome catalysts or even metallocene catalysts.

The term "polypropylene," as used herein, refers to a polymer that comprises, in polymerized form, greater than 50% by mole of units which have been derived from propylene monomer. This includes propylene homopolymer, random copolymer polypropylene, impact copolymer polypropylene, propylene/α-olefin copolymer, and propylene/α-olefin copolymer.

Various embodiments of the present disclosure are directed to airlaid substrates that include at least one bicomponent fiber having a first region and a second region. In one or more embodiments, the first region includes polypropylene. In some embodiments, the second region includes a blend of an ethylene-based polymer and an ethylene acid copolymer. The ethylene-based polymer may have a density of 0.920 (grams per cubic centimeter) g/cm$^3$ to 0.970 g/cm$^3$ and a melt index ($I_2$) of 0.5 grams per 10 minutes (g/10 min.) to 150 g/10 min., as determined by ASTM D1238 at 190 degrees Celsius (° C.) and 2.16 kilograms (kg). The ethylene acid copolymer may include the polymerized reaction product of from 60 percent by weight (wt. %) to 99 wt. % ethylene monomer and from 1 wt. % to 40 wt. % unsaturated dicarboxylic acid comonomer, based on the total weight of the monomers in the ethylene acid copolymer. In embodiments, the ethylene acid copolymer has a melt index ($I_2$) of 0.5 g/10 min. to 500 g/10 min., as determined by ASTM D1238 at 190° C. and 2.16 kg.

In some embodiments, the airlaid substrate includes an amount of pulp. In these embodiments, the airlaid substrate may include at least 50 wt. % pulp, at least 60 wt. % pulp, at least 70 wt. % pulp, or at least 73 wt. % pulp, based on the total weight of the airlaid substrate. The pulp present in the airlaid substrate may include any suitable pulp, such as mechanical pulps and derivatives thereof. In certain embodiments, the pulp present in these embodiments includes fluff pulp.

In one or more embodiments, the pulp includes a fibrous material. The pulp may include lignocellulosic fibrous materials made with ethers or esters of cellulose, which can be obtained from the bark, wood or leaves of plants, or from other plant-based material. In addition to cellulose, the fibrous materials may include hemicellulose and/or lignin. In certain embodiments, the pulp includes cellulose fiber.

In further embodiments, the airlaid substrate has a base weight from 20 grams per square meter (gsm) to 80 gsm. Other suitable base weight ranges of the airlaid substrate include base weights from 20 gsm to 75 gsm, from 20 gsm to 70 gsm, from 20 gsm to 65 gsm, from 25 gsm to 60 gsm, from 25 gsm to 55 gsm, from 25 gsm to 50 gsm, or any other range between 20 gsm and 80 gsm.

Referring now to FIG. 1, the bicomponent fiber 10 includes a first region 12 and a second region 14. The first region 12 may be a core region of the bicomponent fiber 10 and the second region 14 may be a sheath region of the bicomponent fiber 10. In certain embodiments, the sheath region surrounds the core region.

In one or more embodiments, the first region 12 and the second region 14 have a weight ratio of 4:1 to 1:4, based on total weight of the bicomponent fiber 10. Other suitable weight ratios of the first region 12 to the second region 14 include 3.5:1 to 1:3.5, 3:1 to 1:3, 2.5:1 to 1:2.5, 2:1 to 1:2, 1.5:1 to 1:1.5, or a weight ratio of about 1:1.

Further as stated above, the first region 12 of the bicomponent fiber 10 includes polypropylene. The polypropylene of the first region 12 may have a melting temperature of at least 150° C., at least 160° C., at least 170° C., at least 180° C., at least 190° C., or at least 200° C. Moreover, the polypropylene may have a Melt Flow Rate (MFR) from 10 g/10 min. to 100 g/10 min., from 15 g/10 min. to 75 g/10 min., from 20 g/10 min. to 50 g/10 min., or from 22 g/10 min to 28 g/10 min., as determined by ASTM D1238 at 230° C. and 2.16 kg.

The polypropylene present in the first region 12, according to embodiments, is a propylene homopolymer.

In one or more embodiments, the first region 12 of the bicomponent fiber 10 includes at least 75 wt. % of the polypropylene, based on the total weight of the first region 12. In other embodiments, the first region 12 of the bicomponent fiber 10 includes at least 80 wt. %, at least 85 wt. %, or at least 90 wt. % of the polypropylene, based on the total weight of the first region 12. In one embodiment, the polypropylene present in the first region 12 of the bicomponent fiber 10 includes PPH225®, commercially available from Zhejiang Satellite Petrochemical Co. Ltd. (Jiaxing, China).

Referring still to FIG. 1, in additional embodiments, the second region 14 of the bicomponent fiber 10 includes from 60 wt. % to 99 wt. % ethylene-based polymer, based on the total weight of the second region 14. In other embodiments, the second region 14 of the bicomponent fiber 10 includes from 62 wt. % to 99 wt. % ethylene-based polymer, from 64 wt. % to 99 wt. % ethylene-based polymer, from 66 wt. % to 99 wt. % ethylene-based polymer, from 68 wt. % to 99 wt. % ethylene-based polymer, from 70 wt. % to 99 wt. % ethylene-based polymer, from 75 wt. % to 99 wt. % ethylene-based polymer, from 80 wt. % to 99 wt. % ethylene-based polymer, from 85 wt. % to 99 wt. % ethylene-based polymer, from 90 wt. % to 99 wt. % ethylene-based polymer, or from 95 wt. % to 99 wt. % ethylene-based polymer, based on the total weight of the second region 14.

In one or more embodiments, the ethylene-based polymer present in the second region 14 includes any previously described polyethylenes known in the art. These ethylene-based polymers include, for example, LDPEs, LLDPEs, single-site catalyzed LLDPEs, MDPEs, and HDPEs. In certain embodiments, the ethylene-based polymer present in the second region 14 includes HDPE.

In certain embodiments, the ethylene-based polymer in the second region 14 has a density from 0.920 g/cm$^3$ to 0.970 g/cm$^3$. Other suitable density ranges of the ethylene-based polymer in the second region 14 include densities from 0.925 g/cm$^3$ to 0.965 g/cm$^3$, from 0.930 g/cm$^3$ to 0.960 g/cm$^3$, from 0.935 g/cm$^3$ to 0.955 g/cm$^3$, from 0.940 g/cm$^3$ to 0.955 g/cm$^3$, or from 0.945 g/cm$^3$ to 0.955 g/cm$^3$.

In one or more embodiments, the ethylene-based polymer in the second region 14 has a melt index ($I_2$) from 0.5 g/10 min. to 150 g/10 min., as determined by ASTM D1238 at 190° C. and 2.16 kg. Other suitable melt index ($I_2$) ranges of the ethylene-based polymer in the second region 14 include a melt index ($I_2$) from 1.0 g/10 min. to 125 g/10 min., from 5.0 g/10 min. to 100 g/10 min., from 10 g/10 min. to 75 g/10 min., from 10 g/10 min. to 50 g/10 min., from 15 g/10 min. to 25 g/10 min., or from 15 g/10 min. to 20 g/10 min., as determined by ASTM D1238 at 190° C. and 2.16 kg.

In embodiments, the ethylene-based polymer in the second region 14 has a melting temperature of at least 100° C., at least 110° C., at least 120° C., or at least 125° C.

In one embodiment, the ethylene-based polymer of the first composition is an ethylene/α-olefin interpolymer, and further an ethylene/α-olefin copolymer. The α-olefin may have less than, or equal to, 20 carbon atoms. For example, the α-olefin comonomers may have 3 to 10 carbon atoms, or from 3 to 8 carbon atoms. Exemplary α-olefin comonomers include, but are not limited to, propylene, 1-butene, 1-pentene, 1-hexene, 1-heptene, 1-octene, 1-nonene, 1-decene, and 4-methyl-1-pentene. The one or more α-olefin comonomers may, for example, be selected from the group consisting of propylene, 1-butene, 1-hexene, and 1-octene; or in the alternative, from the group consisting of 1-butene, 1-hexene and 1-octene, and further 1-hexene and 1-octene.

In one embodiment, the ethylene-based polymer present in the second region 14 of the bicomponent fiber 10 includes DOW™ HDPE 174530N, commercially available from The Dow Chemical Company (Midland, Michigan).

In embodiments, the second region 14 of the bicomponent fiber 10 includes from 1 wt. % to 40 wt. % ethylene acid copolymer, based on the total weight of the second region 14. In other embodiments, the second region 14 of the bicomponent fiber 10 includes from 1 wt. % to 38 wt. % ethylene acid copolymer, from 1 wt. % to 36 wt. % ethylene acid copolymer, from 1 wt. % to 34 wt. % ethylene acid copolymer, from 1 wt. % to 32 wt. % ethylene acid copolymer, from 1 wt. % to 30 wt. % ethylene acid copolymer, from 1 wt. % to 25 wt. % ethylene acid copolymer, from 1 wt. % to 20 wt. % ethylene acid copolymer, from 1 wt. % to 15 wt. % ethylene acid copolymer, from 1 wt. % to 10 wt. % ethylene acid copolymer, or from 1 wt. % to 5 wt. % ethylene acid copolymer, based on the total weight of the second region 14.

In one or more embodiments, the ethylene acid copolymer includes the polymerization product of an ethylene monomer and an unsaturated dicarboxylic acid comonomer. According to some embodiments, the ethylene acid copolymer includes from 60 wt. % to 99 wt. % ethylene monomer, based on the total weight of the monomers in the ethylene acid copolymer. In other embodiments, the ethylene acid copolymer includes from 65 wt. % to 99 wt. % ethylene monomer, from 70 wt. % to 99 wt. % ethylene monomer, from 75 wt. % to 99 wt. % ethylene monomer, from 80 wt. % to 99 wt. % ethylene monomer, from 85 wt. % to 99 wt. % ethylene monomer, or from 90 wt. % to 99 wt. % ethylene monomer, based on the total weight of the monomers in the ethylene acid copolymer.

In one or more embodiments, the ethylene acid copolymer includes from 1 wt. % to 40 wt. % unsaturated dicarboxylic acid comonomer, based on the total weight of the monomers in the ethylene acid copolymer. In certain embodiments, the ethylene acid copolymer includes from 1 wt. % to 35 wt. % unsaturated dicarboxylic acid, from 1 wt. % to 30 wt. % unsaturated dicarboxylic acid, from 1 wt. % to 25 wt. % unsaturated dicarboxylic acid, from 1 wt. % to 20 wt. % unsaturated dicarboxylic acid, from 1 wt. % to 15 wt. % unsaturated dicarboxylic acid, or from 1 wt. % to 10 wt. % unsaturated dicarboxylic acid, based on the total weight of the monomers in the ethylene acid copolymer.

In embodiments, the ethylene acid copolymer has a melt index ($I_2$) from 0.5 g/10 min. to 500 g/10 min., as determined by ASTM D1238 at 190° C. and 2.16 kg. In other embodiments, the ethylene acid copolymer has a melt index ($I_2$) from 1.0 g/10 min. to 450 g/10 min., from 2.0 g/10 min. to 400 g/10 min., from 5.0 g/10 min. to 350 g/10 min., from 7.5 g/10 min. to 300 g/10 min., from 10 g/10 min. to 250 g/10 min., from 12.5 g/10 min. to 200 g/10 min., from 15 g/10 min. to 150 g/10 min., from 17.5 g/10 min. to 100 g/10 min., from 20 g/10 min. to 50 g/10 min., from 20 g/10 min. to 40 g/10 min., from 20 g/10 min. to 30 g/10 min., or from 22 g/10 min. to 28 g/10 min., as determined by ASTM D1238 at 190° C. and 2.16 kg.

The ethylene acid copolymer, according to some embodiments, has a density of greater than or equal to 0.920 g/cm$^3$. Other suitable densities of the ethylene acid copolymer include densities of greater than or equal to 0.925 g/cm$^3$, 0.930 g/cm$^3$, 0.935 g/cm$^3$, or 0.940 g/cm$^3$. In other embodiments, the ethylene acid copolymer has a density from 0.920 g/cm$^3$ to 0.960 g/cm$^3$. Other suitable density ranges of the ethylene acid copolymer include densities from 0.925 g/cm$^3$ to 0.955 g/cm$^3$, from 0.930 g/cm$^3$ to 0.950 g/cm$^3$, or from 0.935 g/cm$^3$ to 0.945 g/cm$^3$.

Unsaturated dicarboxylic acid comonomers may include maleic acid monoethyl ester, maleic anhydride mono-propyl ester, maleic anhydride mono-ethyl ester, maleic anhydride mono-butyl ester, itaconic acid, fumaric acid, fumaric acid monoester, or combinations thereof; $C_1$-$C_4$-alkyl half esters of these acids, as well as anhydrides of these acids including maleic anhydride, maleic anhydride mono-methyl ester, maleic anhydride mono-ethyl ester, and itaconic anhydride. The carboxylic acid or anhydride units of these monomers are capable of being neutralized with metal ions, just as the monocarboxylic acid carboxylic acid units are, though, as indicated, neutralization of the unsaturated dicarboxylic acid monomers may be different in its nature and effect on polymer properties, including melt behavior. Unsaturated dicarboxylic acids can dehydrate to form intrachain anhydride units within the polymer (i.e., within a chain, rather than crosslinking interchain anhydride units).

Various commercial embodiments are considered suitable for the ethylene acid copolymer. In one embodiment, the ethylene acid copolymer may be Fusabond® M603, commercially available from DuPont™ Co. (Wilmington, Delaware).

The ethylene acid copolymer may be prepared by standard free-radical copolymerization methods, using high pressure, operating in a continuous manner Monomers are fed into the reaction mixture in a proportion, which relates to the monomer's activity, and the amount desired to be incorporated. In this way, uniform, near-random distribution of monomer units along the chain is achieved. Unreacted monomers may be recycled. Additional information on the preparation of ethylene acid copolymers can be found in U.S. Pat. Nos. 3,264,272 and 4,766,174, each of which is hereby incorporated by reference in its entirety. The blend of the second region 14 can be produced by any means known to one skilled in the art.

The first region 12 and the second region 14 of the bicomponent fiber 10 may be prepared by processes well known in the art. One such suitable method of production includes a melt spinning process. In this process, each of the first region 12 and the second region 14 are separately fed into extruders. Once extruded, the product is spun, cooled, and taken up so as to produce continuous filaments. Then, the continuous filaments are stretched, oiled, crimped, and cooled to produce the bicomponent fiber 10 that is incorporated into the airlaid substrate.

The airlaid substrate may be prepared by processes well known in the art. In embodiments, once the bicomponent fiber 10 is produced, the bicomponent fiber 10 may be uniformly mixed with pulp in a hot air current. The bicomponent fiber 10 and pulp mixture is then deposited onto a screen surface to form a web. In embodiments, the web is then subjected to hot air flow, with a temperature from 105° C. to 145° C., for 2 seconds to 60 seconds. In other embodiments, web is then subjected to hot air flow, with a temperature from 135° C. to 139° C., for 4 seconds to 10 seconds. After exposing the web to hot air flow, the airlaid substrate is formed.

The blend can additionally include small amounts of additives including plasticizers, stabilizers including viscosity stabilizers, hydrolytic stabilizers, primary and secondary antioxidants, ultraviolet light absorbers, anti-static agents, dyes, pigments or other coloring agents, inorganic fillers, fire-retardants, lubricants, reinforcing agents such as glass fiber and flakes, foaming or blowing agents, processing aids, slip additives, antiblock agents such as silica or talc, release agents, tackifying resins, or combinations of two or more thereof. Inorganic fillers, such as calcium carbonate, and the like can also be incorporated into the blend.

These additives may be present in the blends in quantities ranging from 0.01 wt. % to 40 wt. %, from 0.01 wt. % to 25 w.t %, from 0.01 wt. % to 15 wt. %, from 0.01 wt. % to 10 wt. %, or from 0.01 wt. % to 5 wt. %. The incorporation of the additives can be carried out by any known process such as, for example, by dry blending, by extruding a mixture of the various constituents, by the conventional masterbatch technique, or the like.

The airlaid substrate, according to embodiments, has a tensile strength of at least 3.0 Newtons per 25 millimeters (N/mm) In further embodiments, the airlaid substrate has a tensile strength of at least 3.1 N/mm, 3.2 N/mm, 3.3 N/mm, 3.4 N/mm, 3.5 N/mm, 3.6 N/mm, 3.7 N/mm, or 3.8 N/mm. In other embodiments, the airlaid substrate has a tensile strength from 3.0 N/mm to 5.0 N/mm, from 3.2 N/mm to 4.8 N/mm, from 3.4 N/mm to 4.6 N/mm, from 3.5 N/mm to 4.4 N/mm, from 3.6 N/mm to 4.2 N/mm, from 3.7 N/mm to 4.0 N/mm, or from 3.8 N/mm to 3.9 N/mm.

In one or more embodiments, the airlaid substrate has a dust level of less than or equal to 6.0%. In further embodiments, the airlaid substrate has a dust level of less than or equal to, 5.8%, 5.6%, 5.4%, 5.2%, 5.0%, 4.8%, 4.6%, 4.4%, 4.2%, 4.0%, 3.9%, 3.8%, 3.7%, 3.6%, 3.5%, 3.0%, 2.5%, or 2.0%.

According to various embodiments, the airlaid substrate may be used to form an adsorbent article. For example, in embodiments, the airlaid substrate can be combined with additives and incorporated into various products to form adsorbent articles of various shapes. Suitable adsorbent articles may include, but are not limited to, disposable diapers, feminine hygiene products, bed pads, incontinence pads, meat/poultry pads, or the like.

EXAMPLES

Test Procedure

Melt Index, (MI) was measured using ASTM D-1238 using a 2160 gram weight at 190° C.

Melt Flow Rate (MFR) was measured using ASTM D-1238 using a 2160 gram weight at 230° C.

Melting Point (Tm) was measured using Differential Scanning calorimetry (DSC). Differential Scanning calorimetry (DSC) is measured on a TA Instruments Q1000 DSC equipped with an RCS cooling accessory and an auto sampler. The melting point (Tm) of the samples are measured according to ASTM D3418.

Tensile strength was determined in machine direction (MD) direction with ASTM D-882-method. A minimum of five specimens were tested in and an average and standard deviation value were obtained to represent each film sample. A film specimen of 25 mm is placed in the grips of a universal tester capable of constant crosshead speed and initial grip separation. The crosshead speed is 500 mm/min with a grip separation of 50 mm. The force as a function of time is measured using a 250 Newton load cell. The elongation is determined from the crosshead speed as a function of time. At least five samples are averaged to determine the tensile values for a film.

Figure 2:
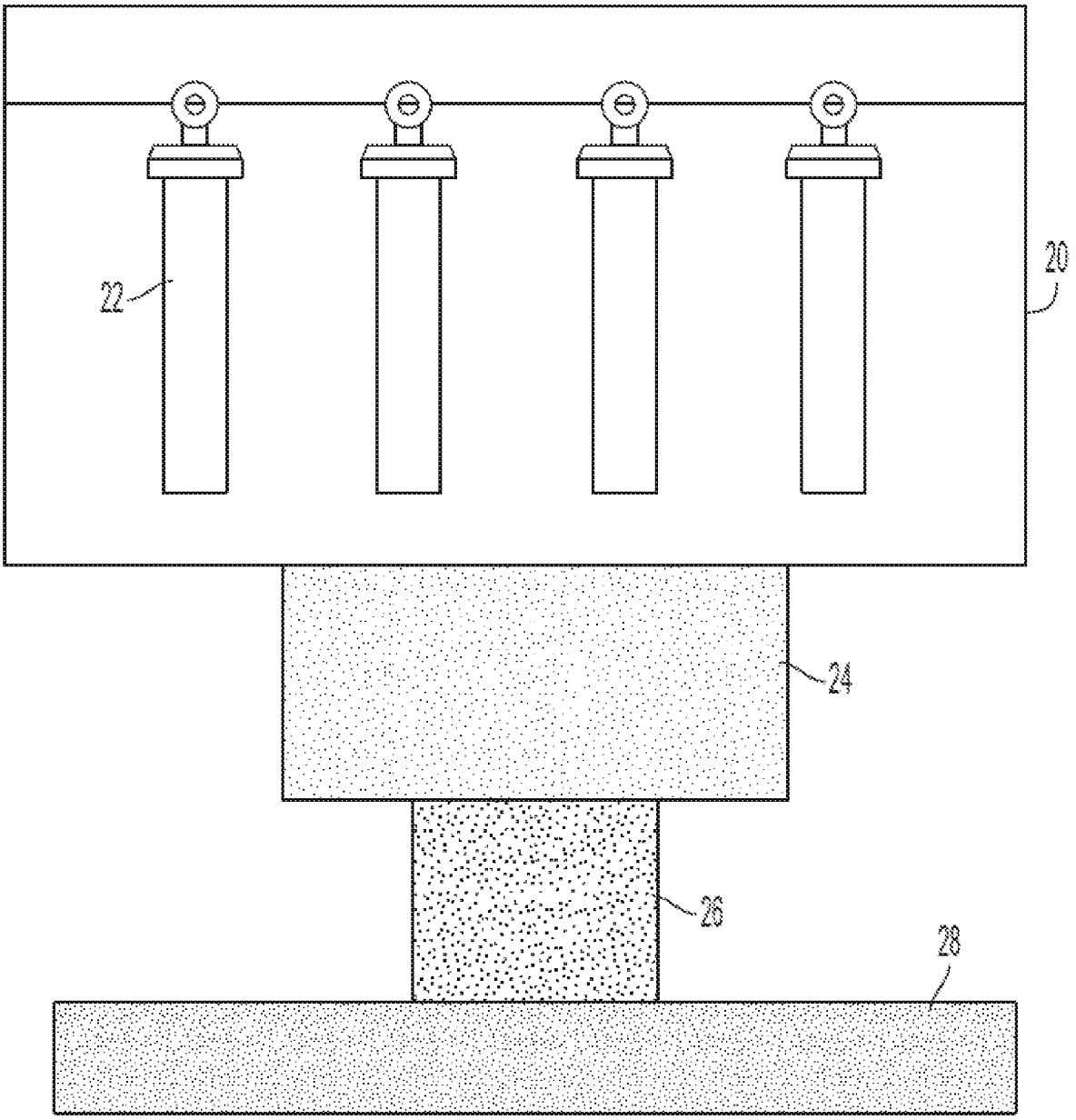
FIG. 2 is a depiction of the apparatus used to measure the dust level of airlaid substrates, according to embodiments of this disclosure.

Dust level percentage was measured by cutting four pieces of the airlaid substrate into 5 cm by 20 cm rectangles, weighing about 1.8 grams total. The four pieces of the airlaid substrate were then weighed to determine their base weight. Referring now to FIG. 2, the pieces of the airlaid substrate 22 were attached to clips inside a container 20, which was then closed to the atmosphere. The container 20 holding the pieces of the airlaid substrate 22 were then shaken by a shaker 24 powered by a motor 26 for five minutes at a frequency of five hertz (Hz). The dust produced by the pieces of airlaid substrate fell to a base 28, positioned below the container 20. After five minutes, the four pieces of the airlaid substrate were again weighed to determine their final weight. The dust level was then determined using the equation Dust Level Percentage=1−(W2/W1), in which W1 is the base weight and W2 is the final weight.

Stiffness was measured using Hand-O-Meter 211 made by Thwing-Albert Instrument Company (West Berlin, NJ). The stiffness of the samples was measured according to ASTM D6828-02 (2015), with the slot width was set to ¼ inch.

The following examples are provided to illustrate various embodiments, but are not intended to limit the scope of the claims. All parts and percentages are by weight unless otherwise indicated. Approximate properties, characters, parameters, and the like, are provided below with respect to various working examples, comparative examples, and the materials used in the working and comparative examples. Further, a description of the raw materials used in the examples is as follows.

The core/sheath bicomponent fiber of the comparative and experimental airlaid substrates was manufactured by a melt spinning process. As such, the core composition and the sheath composition were fed into separate extruders. The compositions were then spun, cooled, and taken up to produce continuous filaments. Then, the filaments were subjected to secondary stretching, oiling, cooling, and cutting in order to produce a bicomponent fiber with a length of 6 mm. The airlaid substrate was then created by introducing fluff pulp and the bicomponent fiber into an air current. The fluff pulp and the bicomponent fiber were uniformly mixed and deposited onto a screen surface to form a web. Finally, the web was subjected to hot air flow for five seconds to bond the fluff pulp and the bicomponent fiber to form the airlaid substrate.

Comparative 1 ("C1") is an airlaid substrate of a blend of 73 wt. % fluff pulp and 27 wt. % bicomponent fiber with a base weight of 45 gsm. The bicomponent fiber included a first region (i.e., a core region) and a second region (i.e., a sheath region) in a 1:1 weight ratio. The first region included polypropylene and the second region included HDPE. The polypropylene used in forming the core region C1 was PPH225®, which is commercially available Zhejiang Satellite Petrochemical Co. Ltd. (Jiaxing, China). The polypropylene PPH225® has a melt flow rate of 25.0±2.0 g/10 min., and a differential scanning calorimetry (DSC) melting temperature of 160° C. The HDPE used in forming C1 was HDPE 17450N®, which is available from The Dow Chemical Company (Midland, Michigan). HDPE 17450N® has a melt flow index ($I_2$) of 17 g/10 min., a density of 0.950 g/cc, and a DSC melting point of 128° C.

Comparative 2 ("C2") is an airlaid substrate of a blend of 73 wt. % fluff pulp and 27 wt. % bicomponent fiber with a base weight of 45 gsm. The bicomponent fiber included a first region (i.e., a core region) and a second region (i.e., a sheath region) in a 1:1 weight ratio. The first region included polypropylene and the second region included a blend of HDPE and maleic anhydride grafted (MAH) polymer. The HDPE was present at 90 wt. % of the blend and the MAH polymer was present at 10 wt. % of the blend, based on the total weight of the second region. The polypropylene used in forming the core region of C2 was PPH225®. The HDPE used in forming the blend of the sheath region of C2 was HDPE 17450N®. The MAH polymer used in forming the blend of the sheath region of C2 was AIVIPLIFY™ GR 204, which is available from Underwriter Laboratories LLC (Northbrook, Illinois). AIVIPLIFY™ GR 204 has a melt flow index ($I_2$) of 12 g/10 min., a density of 0.954 g/cc, and a DSC melting point of 127° C.

Experimental 1 ("E1") is an airlaid substrate of a blend of 73 wt. % fluff pulp and 27 wt. % bicomponent fiber with a base weight of 45 gsm. The bicomponent fiber included a first region (i.e., a core region) and a second region (i.e., a sheath region) in a 1:1 weight ratio. The first region included polypropylene and the second region included a blend of HDPE and ethylene acid copolymer. The HDPE was present at 90 wt. % of the blend and the ethylene acid copolymer was present at 10 wt. % of the blend, based on the total weight of the second region. The polypropylene used in forming the core region of E1 was PPH225®. The HDPE used in forming the blend of the sheath region of E1 was DOW™ HDPE 17450N. The ethylene acid copolymer used in forming the blend of the sheath region of E1 was Fusabond® M603, which is available from Dupont Co. (Wilmington, Delaware). Fusabond® M603 has a melt flow index ($I_2$) of 25 g/10 min., a density of 0.940 g/cc, and a DSC melting point of 108° C.

Example 1—Properties of Airlaid Substrates Bonded at 137° C.

Tensile strength, dust level, and stiffness data of various airlaid substrates is shown in Tables 1 and 2. The results, as summarized in Table 1, include data derived from C1, C2, and E1, the compositions of which are previously described. These samples were exposed to a hot air flow temperature of 137° C., a temperature which provides sufficient bonding strength while preventing the airlaid substrates from becoming brittle.

TABLE 1

Airlaid Substrate Properties when Bonded at 137° C.

| Sample | Tensile Strength (MD) | Dust Level | Stiffness |
|---|---|---|---|
| C1 | 3.3 N/25 mm | 11.15% | 21.1 mN |
| C2 | 2.9 N/25 mm | 6.62% | 31.4 mN |
| E1 | 3.8 N/25 mm | 2.53% | 24.5 mN |

Comparatively, E1, an airlaid substrate containing the ethylene acid copolymer, showed improved tensile strength and dust levels when compared to C1 and C2. The properties of increased tensile strength and decreased dust levels indicated improved adhesion between the pulp and the bicomponent fiber. While E1 showed a stiffness of between what was measured for C1 and C2, the stiffness of E1 is still suitable for consumer needs. The benefit of increased adhesion in E1 outweighs the trade-off of reduced stiffness as compared to MAH containing C2. As such, this data shows that an airlaid substrate containing the ethylene acid copolymer, as previously described in this disclosure, demonstrates improved adhesion when compared to airlaid substrates containing more typical compositions.

Example 2—Properties of Airlaid Substrates Bonded at 139° C.

The results, as summarized in Table 2, include data derived from C1, C2, and E1, the compositions of which are previously described. These samples were exposed to a hot air flow temperature of 139° C., which is nearly the maximum hot air flow temperature that these airlaid substrates may be exposed to since temperatures above 139° C. may cause the airlaid substrates to become brittle.

TABLE 2

Airlaid Substrate Properties when Bonded at 139° C.

| Sample | Tensile Strength | Dust Level | Stiffness |
|---|---|---|---|
| C1 | 3.3 N/25 mm | 10.93% | 29.8 mN |
| C2 | 3.1 N/25 mm | 3.63% | 34.8 mN |
| E1 | 3.9 N/25 mm | 1.73% | 33.1 mN |

Again, E1, an airlaid substrate containing the ethylene acid copolymer, showed increased tensile strength and reduced dust levels when compared to C1 and C2, which indicates improved adhesion between the pulp and the bicomponent fiber. While E1 showed a stiffness of less than what was measured for C2, the stiffness of E1 is still suitable for consumer needs. Therefore, E1 indicates that a superior balance of all properties is achieved when compared to C1 and C2.

Overall, the airlaid substrates described in the present disclosure that include a second region containing a blend of an ethylene-based polymer and an ethylene acid copolymer show improved adhesion when compared to conventional airlaid substrates. Such features are especially noted by the low dust levels achieved by the experimental airlaid substrate E1.

According to a first aspect of the present disclosure, an airlaid substrate including at least one bicomponent fiber having a first region and a second region is disclosed. The first region includes polypropylene. The second region includes an ethylene-based polymer having a density from 0.920 g/cm$^3$ to 0.970 g/cm$^3$ and a melt index ($I_2$) from 0.5 g/10 min. to 150 g/10 min., as determined by ASTM D1238 at 190° C. and 2.16 kg; and an ethylene acid copolymer including the polymerized reaction product of from 60 wt. % to 99 wt. % ethylene monomer and from 1 wt. % to 40 wt. % unsaturated dicarboxylic acid comonomer, based on the total weight of the monomers in the ethylene acid copolymer, the ethylene acid copolymer having a melt index ($I_2$) from 0.5 g/10 min. to 500 g/10 min., as determined by ASTM D1238 at 190° C. and 2.16 kg.

A second aspect of the present disclosure may include the first aspect, wherein the airlaid substrate including at least 50 wt. % pulp, preferably at least 70% wt. % pulp, based on the total weight of the airlaid substrate.

A third aspect of the present disclosure may include the first aspect or the second aspect, wherein the pulp is bonded to the bicomponent fiber.

A fourth aspect of the present disclosure may include any of the first through third aspects, wherein the pulp includes cellulose fiber.

A fifth aspect of the present disclosure may include any of the first through fourth aspects, wherein the first region is a core region of the bicomponent fiber, the second region is a sheath region of the bicomponent fiber, and the sheath region surrounds the core region.

A sixth aspect of the present disclosure may include any of the first through fifth aspects, wherein the first region and the second region have a weight ratio of 4:1 to 1:4, based on total weight of bicomponent fiber.

A seventh aspect of the present disclosure may include any of the first through sixth aspects, wherein the first region includes at least 75 wt. % of the polypropylene, based on the total weight of the first region.

An eighth aspect of the present disclosure may include any of the first through seventh aspects, wherein the polypropylene of the first region has a melt temperature of at least 150° C. and a melt flow rate (MFR) of 10 g/10 min. to 100 g/10 min., as determined by ASTM D1238 at 230° C. and 2.16 kg.

A ninth aspect of the present disclosure may include any of the first through eighth aspects, wherein the second region includes from 60 wt. % to 99 wt. % ethylene-based polymer, preferably 80 wt. % to 99 wt. % ethylene-based polymer, based on the total weight of the second region; and from 1 wt. % to 40 wt. % ethylene acid copolymer, preferably 1 wt. % to 20 wt. % ethylene acid copolymer, based on the total weight of the second region.

A tenth aspect of the present disclosure may include any of the first through ninth aspects, wherein the ethylene-based polymer in the second region has a density from 0.930 g/cm$^3$ to 0.960 g/cm$^3$ and a melt index ($I_2$) of 10 g/10 min. to 50 g/10 min., as determined by ASTM D1238 at 190° C. and 2.16 kg.

An eleventh aspect of the present disclosure may include any of the first through tenth aspects, wherein the ethylene acid copolymer includes from 85 wt. % to 99 wt. % ethylene monomer, based on the total weight of the monomers in the ethylene acid copolymer; and from 1 wt. % to 15 wt. % unsaturated dicarboxylic acid comonomer, based on the total weight of the monomers in the ethylene acid copolymer.

A twelfth aspect of the present disclosure may include any of the first through eleventh aspects, wherein the ethylene acid copolymer in the second region has a density of greater than or equal to 0.930 g/cm$^3$.

A thirteenth aspect of the present disclosure may include any of the first through twelfth aspects, wherein the ethylene acid copolymer in the second region has a density of 0.935 g/cm$^3$ to 0.945 g/cm$^3$ and a melt index ($I_2$) of 22 g/10 min. to 28 g/10 min., as determined by ASTM D1238 at 190° C. and 2.16 kg.

A fourteenth aspect of the present disclosure may include any of the first through thirteenth aspects, wherein the unsaturated dicarboxylic acid comonomer of the ethylene acid copolymer includes maleic acid monoethyl ester, maleic anhydride, maleic anhydride mono-methyl ester, maleic anhydride mono-propyl ester, maleic anhydride mono-butyl ester, itaconic acid, fumaric acid, fumaric acid monoester, or combinations thereof.

A fifteenth aspect of the present disclosure may include an adsorbent article including the airlaid substrate of any of the first through fourteenth aspects.

It will be apparent that modifications and variations are possible without departing from the scope of the disclosure defined in the appended claims. More specifically, although some aspects of the present disclosure are identified herein as preferred or particularly advantageous, it is contemplated that the present disclosure is not necessarily limited to these aspects.

What is claimed is:

1. An airlaid substrate comprising at least one bicomponent fiber having a first region and a second region, wherein:

the first region comprises polypropylene; and the second region comprises a blend of:

an ethylene-based polymer having a density from 0.920 g/cm$^3$ to 0.970 g/cm$^3$ and a melt index ($I_2$) from 0.5 g/10 min. to 150 g/10 min., as determined by ASTM D1238 at 190° C. and 2.16 kg; and an ethylene acid copolymer comprising the polymerized reaction product of from 60 wt. % to 99 wt. % ethylene monomer and from 1 wt. % to 40 wt. % unsaturated dicarboxylic acid comonomer, based on the total weight of the monomers in the ethylene acid copolymer, the ethylene acid copolymer having a melt index ($I_2$) from 0.5 g/10 min. to 500 g/10 min., as determined by ASTM D1238 at 190° C. and 2.16 kg.

2. The airlaid substrate of claim 1, wherein the airlaid substrate comprises at least 50 wt. % pulp based on the total weight of the airlaid substrate.

3. The airlaid substrate of claim 2, wherein the pulp is bonded to the bicomponent fiber.

4. The airlaid substrate of claim 2, wherein the pulp comprises cellulose fiber.

5. The airlaid substrate of claim 1, wherein the first region is a core region of the bicomponent fiber, the second region is a sheath region of the bicomponent fiber, and the sheath region surrounds the core region.

6. The airlaid substrate of claim 1, wherein the first region and the second region have a weight ratio of 4:1 to 1:4, based on total weight of bicomponent fiber.

7. The airlaid substrate of claim 1, wherein the first region comprises at least 75 wt. % of the polypropylene, based on the total weight of the first region.

8. The airlaid substrate of claim 1, wherein the polypropylene of the first region has a melt temperature of at least 150° C. and a melt flow rate (MFR) of 10 g/10 min. to 100 g/10 min., as determined by ASTM D1238 at 230° C. and 2.16 kg.

9. The airlaid substrate of claim 1, wherein the second region comprises:

from 60 wt. % to 99 wt. % ethylene-based polymer, based on the total weight of the second region; and from 1 wt. % to 40 wt. % ethylene acid copolymer, based on the total weight of the second region.

10. The airlaid substrate of claim 1, wherein the ethylene-based polymer in the second region has a density from 0.930 g/cm$^3$ to 0.960 g/cm$^3$ and a melt index ($I_2$) of 10 g/10 min. to 50 g/10 min., as determined by ASTM D1238 at 190° C. and 2.16 kg.

11. The airlaid substrate of claim 1, wherein the ethylene acid copolymer comprises:

from 85 wt. % to 99 wt. % ethylene monomer, based on the total weight of the monomers in the ethylene acid copolymer; and from 1 wt. % to 15 wt. % unsaturated dicarboxylic acid comonomer, based on the total weight of the monomers in the ethylene acid copolymer.

12. The airlaid substrate of claim 1, wherein the ethylene acid copolymer in the second region has a density of greater than or equal to 0.930 g/cm$^3$.

13. The airlaid substrate of claim 1, wherein the ethylene acid copolymer in the second region has a density of 0.935 g/cm$^3$ to 0.945 g/cm$^3$ and a melt index ($I_2$) of 22 g/10 min. to 28 g/10 min., as determined by ASTM D1238 at 190° C. and 2.16 kg.

14. The airlaid substrate of claim 1, wherein the unsaturated dicarboxylic acid comonomer of the ethylene acid copolymer comprises maleic acid monoethyl ester maleic anhydride maleic anhydride mono-methyl ester maleic anhydride mono-propyl ester, maleic anhydride mono-butyl ester, itaconic acid, fumaric acid, fumaric acid monoester, or combinations thereof.

15. The airlaid substrate of claim 1, wherein the airlaid substrate comprises at least 70% wt. % pulp, based on the total weight of the airlaid substrate.

16. The airlaid substrate of claim 1, wherein the second region comprises:

from 80 wt. % to 99 wt. % ethylene-based polymer, based on the total weight of the second region; and from 1 wt. % to 20 wt. % ethylene acid copolymer, based on the total weight of the second region.

17. An adsorbent article comprising the airlaid substrate of claim 1.

* * * * *